US012593950B2

(12) United States Patent
Stuive et al.

(10) Patent No.: US 12,593,950 B2
(45) Date of Patent: Apr. 7, 2026

(54) WAND WITH INTEGRAL HOSE CLEANOUT FEATURE

(71) Applicant: BISSELL Inc., Grand Rapids, MI (US)

(72) Inventors: Eric J. Stuive, Zeeland, MI (US); Derek Smith, Grand Rapids, MI (US)

(73) Assignee: BISSELL, Inc., Grand Rapids, MI (US)

( * ) Notice: Subject to any disclaimer, the term of this patent is extended or adjusted under 35 U.S.C. 154(b) by 336 days.

(21) Appl. No.: 18/218,929

(22) Filed: Jul. 6, 2023

(65) Prior Publication Data

US 2024/0008702 A1 Jan. 11, 2024

Related U.S. Application Data

(60) Provisional application No. 63/359,193, filed on Jul. 7, 2022.

(51) Int. Cl.
*A47L 9/24* (2006.01)
*A47L 11/40* (2006.01)

(52) U.S. Cl.
CPC ..... *A47L 9/248* (2013.01); *A47L 11/4088* (2013.01)

(58) Field of Classification Search
CPC .. A47L 11/30; A47L 11/4044; A47L 11/4088; A47L 9/248
USPC ..... 15/3.5
See application file for complete search history.

(56) References Cited

U.S. PATENT DOCUMENTS

| | | | |
|---|---|---|---|
| 4,159,554 A | 7/1979 | Knight et al. | |
| 6,453,507 B1 | 9/2002 | Gilbert | |
| 10,548,450 B2 | 2/2020 | Hess et al. | |
| 10,588,476 B2 | 3/2020 | Royale et al. | |
| 2005/0015916 A1 | 1/2005 | Orubor | |
| 2005/0023377 A1 | 2/2005 | Kawamoto | |
| 2017/0127900 A1 | 5/2017 | Wright et al. | |
| 2018/0103817 A1 | 4/2018 | Nadal | |
| 2020/0178749 A1* | 6/2020 | Royale | A47L 11/4091 |
| 2022/0053989 A1 | 2/2022 | Royale et al. | |

FOREIGN PATENT DOCUMENTS

| | | | |
|---|---|---|---|
| CA | 2431445 | C | 4/2012 |
| CN | 113020143 | A | 6/2021 |
| DE | 205060 | C | 12/1908 |
| EP | 3016566 | B1 | 12/2022 |
| WO | 2022150546 | A1 | 7/2022 |
| WO | 2022199272 | A1 | 9/2022 |

* cited by examiner

*Primary Examiner* — Katina N. Henson

(74) *Attorney, Agent, or Firm* — Price Heneveld LLP

(57) ABSTRACT

An accessory tool usable with an extraction cleaner having fluid delivery and recovery systems includes a conduit body, spray nozzle, and first and second valves. The conduit body contains a fluid delivery pathway and an airflow pathway. The fluid delivery pathway connects to the fluid delivery system at a hose end of a wand. The airflow pathway connects to the fluid recovery system at the same hose end. The spray nozzle is in fluid communication with the fluid delivery pathway. The second valve is operable for selectively directing a liquid stream, i.e., cleaning fluid provided by the extraction cleaner, to the spray nozzle when the hose end is attached to the extraction cleaner via an accessory hose. The first valve is operable for selectively diverting the liquid stream into the airflow pathway to clean the hose.

17 Claims, 7 Drawing Sheets

WAND WITH INTEGRAL HOSE CLEANOUT FEATURE

CROSS-REFERENCE TO RELATED APPLICATION

This application claims priority to and the benefit under 35 U.S.C. § 119(e) of U.S. Provisional Application No. 63/359,193, filed on Jul. 7, 2022, entitled "WAND WITH INTEGRAL HOSE CLEANOUT FEATURE," the disclosure of which is hereby incorporated herein by reference in its entirety.

TECHNICAL FIELD

The subject disclosure pertains to upright or portable extraction cleaners having hose-connected accessory tools. In particular, the subject disclosure pertains to a fluid conduit or tool attachment piece ("wand") configured for connecting such an accessory tool to a proximal end of a flexible accessory hose, with a distal end of the accessory hose being connectable to the extraction cleaner.

BACKGROUND

Accessory tools for use with an extraction cleaner typically include a suction nozzle through which liquid and entrained debris are extracted from a surface during an extraction cleaning process. For example, common household extraction cleaning tasks can often be performed using a cleaning fluid, e.g., water or a liquid cleaning solution containing surfactants, stabilizers, fragrances, or other active and inactive ingredients. Fluid-based or "wet" extraction cleaners include a housing that carries separate fluid delivery and recovery systems. The fluid delivery system directs the cleaning fluid to the surface to be cleaned, while the fluid recovery system extracts the cleaning fluid and entrained debris from the surface and deposits the extracted fluid and debris in a recovery tank for disposal.

As part of the fluid delivery system, the above-described cleaning fluid is dispensed from the above-described fluid supply tank, through a fluid supply conduit disposed within an accessory hose, and onto the surface to be cleaned, such as through one or more nozzle orifices of the accessory tool or using an external spray nozzle. The dispensed cleaning fluid in some accessory tool embodiments can be agitated using a brush or needles of the accessory tool to help capture embedded dirt, pet dander, and other debris. A suction source located aboard the extraction cleaner generates suction forces to extract spent fluid and entrained debris from the surface.

BRIEF SUMMARY

Disclosed herein is a fluid coupling device ("wand") for connecting an accessory hose to an accessory tool of an extraction cleaner having separate fluid delivery and recovery systems, extraction cleaners equipped with such a wand, and related methods for using the wand to selectively clean the accessory hose when cleaning a surface. Over time, fluid-based extraction cleaning processes can see a gradual accumulation and build-up of extracted debris within the accessory hose, i.e., along its interior walls. Such build-up tends to be prevalent in close proximity to the wand and a hose coupling used to connect the wand to the accessory hose. Accumulated debris, depending on its amount and composition, can emit unpleasant odors and potentially degrade cleaning performance. It is therefore desirable to periodically purge the hose of such debris. However, commercially available approaches for cleaning an accessory hose can be relatively cumbersome and time consuming, such as by requiring the user to periodically connect the accessory hose to a dedicated cleaning system to flush or suction out accumulated debris. Further, commercially available approaches for cleaning an accessory hose may also require separate components that can be lost or broken over time.

An alternative user-friendly solution for removing accumulated debris from an accessory hose is described below. In the present approach, the wand contains a fluid delivery pathway and an airflow pathway. The fluid delivery pathway is configured to connect to the fluid delivery system of the extraction cleaner via the accessory hose. The airflow pathway in turn is configured to connect to the fluid recovery system of the extraction cleaner via the accessory hose, with this connection also being established at the hose end. A tool end of the wand is selectively connectable to an accessory tool, e.g., a hand-maneuverable carpet or upholstery cleaning tool having a suction nozzle.

In this exemplary construction, the wand also includes a spray nozzle and a pair of actuatable valves, with the valves nominally referred to hereinbelow as first and second valves for illustrative clarity. For example, the first and second valves can be normally closed, spring-biased valves that conduct cleaning fluid therethrough when the valves are actuated, e.g., by a force applied by a user to an accompanying actuator such as a push button or a trigger mechanism as appreciated in the art. The spray nozzle is in fluid communication with the fluid delivery pathway of the wand. The first valve is operable for selectively directing a liquid stream, i.e., some of the aforementioned cleaning fluid, to the second valve for supplying the spray nozzle. This can occur when the wand is attached to the extraction cleaner via the accessory hose. The first valve in this particular embodiment is also operable for selectively and temporarily diverting some of the liquid stream into the airflow pathway to flush accumulated debris from the accessory hose. In other words, a user can periodically flush the wand and accessory hose during the extraction cleaning process at the user's discretion via a simple button pushing or similar operation.

The wand as described in detail below may include a conduit body having an outer wall and an inner wall, with the outer and inner walls together at least partially defining the airflow pathway. The wand is generally cylindrical or tubular, although not necessarily circular in cross-section, such that the conduit body defines sufficient internal volume for containing and protecting the first and second valves, tubing connecting the valves, and any required tubing or fittings needed to couple the wand to the extraction cleaner via the accessory hose.

The first valve can include a first/steady-state position configured to direct the liquid stream to the second valve, and a second/bypass position in which the first valve temporarily diverts the liquid stream (cleaning fluid) into the airflow pathway, e.g., through one or more orifices of the inner wall or a cap connected thereto or integrally formed therewith. For instance, an actuator could be configured to selectively transition the first valve from the steady-state position to the bypass position when activated by a user of the extraction cleaner.

In a representative construction, the actuator can include a spring-biased button or plunger as noted above. In this representative construction, an arcuate or annular standoff can at least partially surround an outer perimeter of the spring-biased button or plunger, with the standoff protruding from the outer wall of the wand to help prevent an unintended actuation of the first valve.

In one or more embodiments, the wand can include a detent device in engagement with the above-summarized actuator. The optional detent device could provide tactile and/or audible feedback to a user of the wand, e.g., by providing an audible "click" sound or feel indicative of sufficient actuation force on the actuator. The detent device could be spring-loaded so as to remain applied when the user removes the apply force from the actuator, requiring a second application of apply force to revert to the steady-state position, or the detent device could be configured to require a sustained apply force for establishing the bypass position in different embodiments.

An aspect of the disclosure includes an outer wall of the wand defining an opening, e.g., a circular or rectangular through-hole, with a sight window disposed within the opening to provide a user of the wand with a clear view of the airflow pathway therewithin. The sight window can be coaxially aligned with a center axis of the first valve in one or more embodiments such that the sight window is situated directly above the first valve. Alternatively, the sight window could be situated off-axis relative to the first valve as summarized below, or the outer wall of the wand could be constructed in part or in whole from transparent or translucent materials to provide a larger viewing area.

The wand can optionally include or define a cap situated above the first valve, with the cap defining the one or more orifices noted above. Such a cap could be connected to or formed integrally with an optional baffle piece, with the baffle piece being configured to deflect the liquid stream flowing through the orifice(s) of the cap back toward the hose end of the wand. In constructions employing the baffle piece, the first valve could be located off-axis relative to the sight window, with the baffle piece diverting the fluid stream toward and onto the sight window in such embodiments.

In a possible construction, the spray nozzle could be connected to or formed integrally with the wand. The second valve in such an embodiment can be actuatable via an optional trigger mechanism disposed on an undersurface of the wand.

Another aspect of the subject disclosure include an extraction cleaner having a fluid delivery system, a fluid recovery system, an accessory hose connectable to the fluid delivery and recovery systems, an accessory tool, and a wand. The wand in this non-limiting embodiment includes a tool end connectable to the accessory tool and a hose end connectable to the accessory hose. The wand defines therein a fluid delivery pathway and an airflow pathway. At the hose end of the wand, the fluid delivery pathway connects to the fluid delivery system and the airflow pathway connects to the fluid recovery system.

A spray nozzle is in fluid communication with the fluid delivery pathway in this exemplary embodiment. A first valve is operable for selectively directing the liquid stream to a second valve for supplying cleaning fluid to the spray nozzle. This occurs when the hose end is attached to the extraction cleaner via the accessory hose. Additionally, the first valve is operable for selectively diverting the liquid stream into the airflow pathway.

Also disclosed herein is a tool assembly for use with an extraction cleaner having an accessory hose, a fluid delivery system, and a fluid recovery system. An embodiment of the tool assembly includes an accessory tool and a wand, with the accessory tool having a tool body defining a suction nozzle. The wand in this representative construction includes a sight window, a spray nozzle, and first and second valves. A tool end of the wand is configured to connect to the accessory tool and a hose end of the wand is configured to connect to the accessory hose. Additionally, the wand defines a fluid delivery pathway and an airflow pathway respectively connectable via the accessory hose to the fluid delivery and recovery systems.

In a non-limiting embodiment, the sight window is disposed within a wall of the wand. The spray nozzle is configured to direct a liquid stream from the fluid delivery pathway onto a surface to be cleaned. The second valve is configured when actuated to direct the liquid stream to the spray nozzle. The first valve is configured when actuated to a bypass position to direct the liquid stream into the airflow pathway and toward the sight window to clean out the accessory hose, and to direct the liquid stream to the second valve when the first valve is in a default steady-state position.

The above summary is not intended to represent every possible construction or aspect of the subject disclosure. Rather, the foregoing summary is intended to exemplify some of the novel aspects and features disclosed herein. The above-summarized features and other features and advantages of the subject disclosure will be readily apparent from the following detailed description of representative embodiments and modes for carrying out the subject disclosure when taken in connection with the accompanying drawings and the appended claims.

BRIEF DESCRIPTION OF THE DRAWINGS

The drawings described herein are for illustrative purposes only, are schematic in nature, and are intended to be exemplary rather than to limit the scope of the disclosure.

The appended drawings are not necessarily to scale and may present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The subject disclosure may be embodied in many different forms. Representative examples are shown in the various drawings and described in detail below, with the understanding that the descriptions are exemplifications of the disclosed principles and not limitations of the broad aspects of the disclosure. To that end, elements and limitations described below, but not explicitly set forth in the claims, should not be incorporated into the claims, singly or collectively, by implication, inference, or otherwise. Moreover, the drawings discussed herein may not be to scale, and are provided purely for instructional purposes. Thus, the specific and relative dimensions shown in the Figures are not to be construed as limiting.

Additionally, unless specifically disclaimed: the singular includes the plural and vice versa; the words "and" and "or" shall be both conjunctive and disjunctive; the words "any" and "all" shall both mean "any and all"; and the words "including," "containing," "comprising," "having," along with permutations thereof and similar terms, shall each mean "including without limitation." Further, the words "example" or "exemplary" are used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. Moreover, words of approximation, such as "about," "almost," "substantially," "generally," "approximately," and the like, may each be used herein in the sense of "at, near, or nearly at," or "within 0-5% of," or "within acceptable manufacturing tolerances," or any logical combination thereof, for example.

As summarized above, it is desirable to prevent accumulation of extracted debris within an accessory hose of an upright or portable extraction cleaner. Such extraction cleaners are typically equipped to receive a flexible accessory hose, with an opposing end of the accessory hose being configured to connect to an accessory tool, e.g., a hand-maneuverable suction tool for cleaning floors, stairs, furniture, drapes, and the like. The hardware solutions described in detail below are therefore intended to help a user remove accumulated debris in a user-friendly manner relative to traditional hose cleaning devices.

Figure 1:
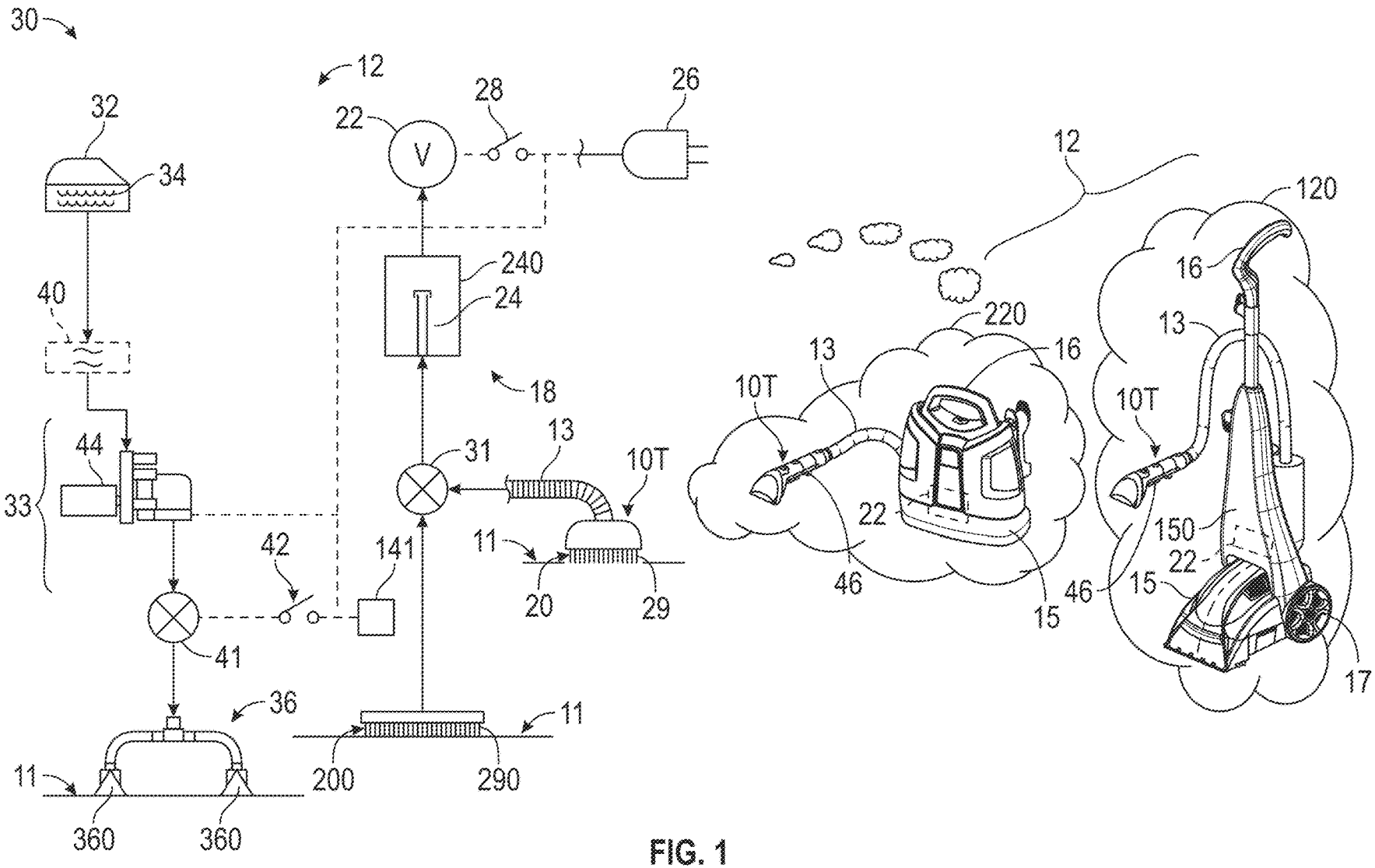
FIG. 1 is a schematic view of an extraction cleaner fluid circuit having a wand-integrated hose cleanout feature as described in detail herein.

Referring to the drawings, wherein like reference numbers refer to the same or like components in the several Figures, and beginning with FIG. 1, an accessory tool 10T is usable with a variety of extraction cleaners 12, with the extraction cleaner 12 exemplified as an upright extraction cleaner 120 and a portable extraction cleaner 220. Representative configurations can be found in U.S. Pat. No. 8,707,510 to Reed, Jr., U.S. Pat. No. 8,991,000 Huffman et al., and U.S. Pat. No. 9,867,517 to Krebs et al., which are hereby incorporated by reference herein in their respective entireties.

The accessory tool 10T is selectively connectable to the extraction cleaner 12 via an accessory hose 13 and a wand 46 (see FIG. 2), i.e., a conduit serving as an intervening attachment piece for coupling the accessory tool 10T to the accessory hose 13. As summarized above, an interior of the accessory hose 13 over time and with extensive usage can become coated with dirt, pet dander, hair, and other debris as summarized above, all of which can emit unpleasant odors. The present disclosure is therefore directed to wand-integrated solutions for removing such accumulated debris in a user-friendly and time efficient manner, with exemplary constructions of the wand 46 for this purpose described in detail below with reference to FIGS. 2-8.

The extraction cleaner 12 of FIG. 1 as contemplated herein includes a fluid recovery system 18 having a suction source (V) 22 for cleaning a surface 11, e.g., carpeting, rugs, upholstery, drapes, etc., and a fluid delivery system 30 for supplying an application-suitable cleaning fluid to the surface 11. The accessory tool 10T, within the scope of the present disclosure, is selectively connectable to the extraction cleaner 12 via a flexible length of the accessory hose 13 to allow a user to more easily position and maneuver the accessory tool 10T during an extraction cleaning process. As part of this process, a diverter valve 31 of the fluid recovery system 18 can fluidly connect the suction source 22 to either a suction nozzle 200 of the extraction cleaner 12, e.g., the upright extraction cleaner 120, or to a suction nozzle 20 of the accessory tool 10T.

The extraction cleaner 12 in its various embodiments includes a housing 15 and a handle 16 coupled or formed integrally therewith. A handle 16 of the portable extraction cleaner 220 in particular facilitates unit portability by allowing a user to lift and carry the portable extraction cleaner 220. The upright extraction cleaner 120 for its part, of which the housing 15 acts as a lower housing that is pivotably connected to an upper housing 150, may be connected to a set of wheels 17 or another suitable surface drive mechanism to enable a user to roll the upright extraction cleaner 120 along the surface 11. The fluid recovery system 18 carried by the housing 15 is in fluid communication with the suction nozzles 20 and 200, with the suction nozzle 20 being an integral component of the accessory tool 10T as described in greater detail below with reference to FIGS. 2-8.

The fluid recovery system 18 shown schematically in FIG. 1 includes the aforementioned suction source 22, e.g., a motorized fan assembly, which in turn is in fluid communication with the suction nozzles 20 and 200 and operable for generating a working airstream or airflow. Additionally, the fluid recovery system 18 can include a separator 24 formed in a portion of the recovery tank 240 for separating fluid and entrained debris from a working airstream.

The suction source 22 for its part can be electrically coupled to a power source 26 (schematically represented as a power plug connectable thereto for simplicity), such as a battery or by a power cord plugged into a household electrical outlet. A power switch 28 disposed between the suction source 22 and the power source 26 can be selectively closed by a user, e.g., upon pressing a vacuum power button (not shown), thereby activating the suction source 22 as needed. Optionally, an agitator 29 can be provided adjacent to the suction nozzle 20 of the accessory tool 10T or as an agitator 290 adjacent to the suction nozzle 200 of the extraction cleaner 12 for agitating fluid and debris when cleaning the surface 11. Non-limiting examples of the agitators 29 and 290 include polymeric bristles, bristle strips, tufts, brushes, needles, or other projections, or possibly a rubber squeegee surface or nub protrusions to help remove pet hair from upholstery during cleaning.

Also shown schematically in FIG. 1 is the fluid delivery system 30, which can include one or more fluid supply tanks 32 for storing a volume of a liquid cleaning fluid 34. For instance, common household extraction cleaning tasks can often be performed using water or a water-based cleaning solution containing surfactants, stabilizers, fragrances, and other active and inactive ingredients. The cleaning fluid 34 therefore can be any application-suitable treating agent(s) or mixtures thereof.

An optional heater 40 can be used for heating the cleaning fluid 34 prior to delivering the cleaning fluid 34 to the surface 11. For instance, an in-line heater variant of the heater 40 could be located downstream of the fluid supply tank(s) 32 and upstream of a fluid pump 44 as shown. Other types of heaters 40 can be used within the scope of the disclosure, such as heating via exhaust from the suction source 22.

The fluid delivery system 30 depicted schematically in FIG. 1 also includes a fluid dispenser 36 for dispensing the cleaning fluid 34 onto the surface 11 as part of the normal floor cleaning operation of the extraction cleaner 12, in this instance the upright extraction cleaner 120. Although only one supply tank 32 is shown for illustrative simplicity and clarity, those skilled in the art will appreciate that additional supply tanks 32 could be used in other embodiments. For instance, one of the supply tanks 32 could store clean water and one or more additional supply tanks 32 could store a detergent-based cleaning solution. Outlet flow from the different supply tanks 32 in such a construction could be mixed using a mixing valve or other suitable approaches to control a composition of the fluid ultimately dispensed to the surface 11.

The fluid delivery system 30 of FIG. 1 can also include a flow control system 33. In a possible construction, the flow control system 33 includes the fluid pump 44, e.g., a centrifugal or solenoid pump, which is operable for pressurizing the fluid delivery system 30 to force the cleaning fluid 34 through a liquid supply conduit and ultimately out of the fluid dispenser 36, e.g., through one or more spray tips 360. A flow control valve 41 and actuator 141 may be used to control this process.

For instance, the flow control valve 41 could be actuated via the actuator 141 via an electrical switch 42 disposed between the flow control valve 41 and the power source 26 noted above. Such an electrical switch 42 can be selectively closed when the actuator 141 is activated, thereby powering the flow control valve 41 to an open position and thus allowing the cleaning fluid 34 to be dispensed. The accessory hose 13 is likewise connected to the flow control valve 41 when the accessory hose 13 is connected to the extraction cleaner 12, such that the fluid delivery process described above temporarily diverts the cleaning fluid 34 to the surface 11 through the accessory tool 10T, as will now be described with reference to the remaining Figures.

Figure 2:
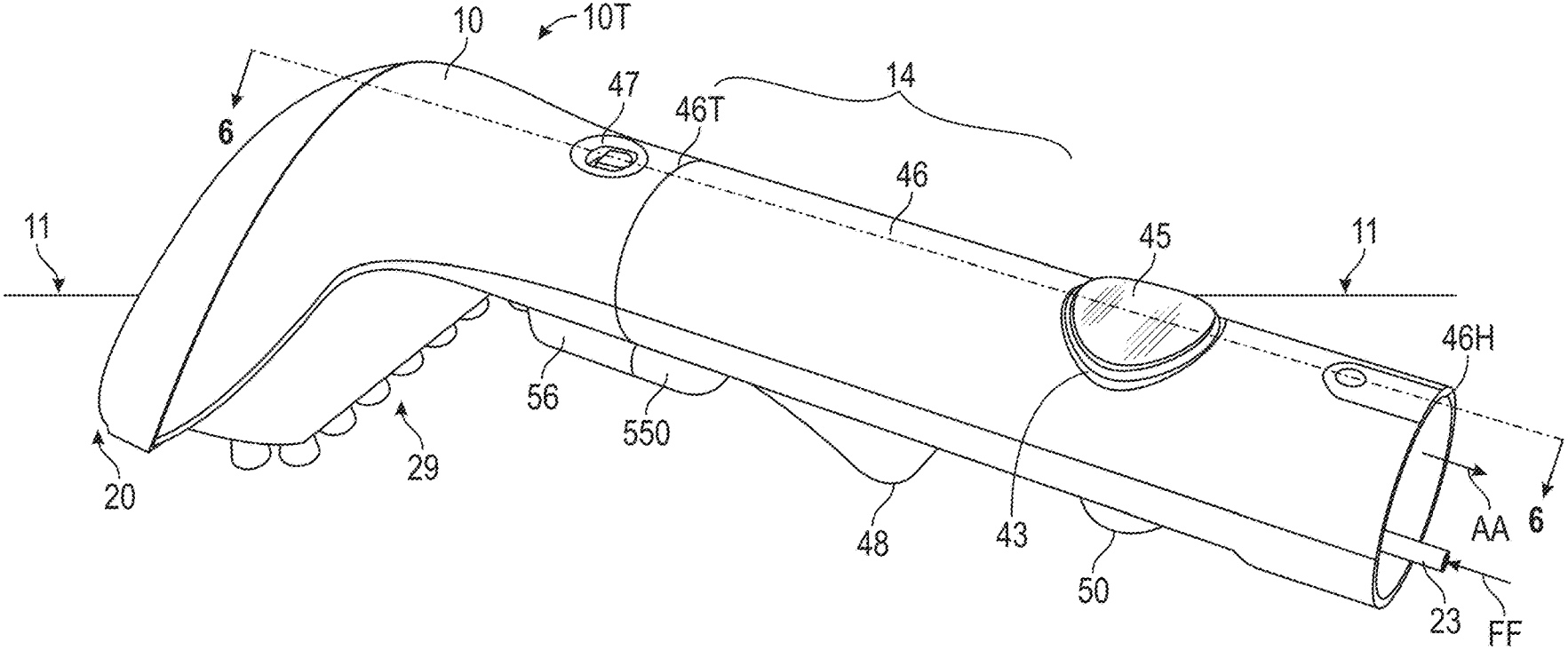
FIG. 2 is a top perspective view of a representative tool assembly having an accessory tool and wand, with the wand being equipped with an integrated hose cleanout feature in accordance with an aspect of the disclosure.

Referring to FIG. 2, within the scope of the present disclosure a tool assembly 14 includes the accessory tool 10T and the wand 46. A cut line 6-6 is shown through a longitudinal centerline of the tool assembly 14, with the cut line 6-6 used below to establish the cross-sectional views of FIGS. 6 and 8. The accessory tool 10T as contemplated herein includes a tool body 10, with the tool body 10 shown connected to the wand 46 and having the above-summarized suction nozzle 20. During an extraction cleaning process of the surface 11 when the accessory tool 10T and the wand 46 are securely connected to the extraction cleaner 12 of FIG. 1 via the accessory hose 13, the cleaning fluid 34 of FIG. 1 enters the wand 46 as indicted by arrow FF, such as through a tubular fluid conduit 23. This occurs as airflow (arrow AA) due to applied suction forces from the suction source 22 of FIG. 1, and possible entrained fluid and debris, passes from the wand 46 in the opposite direction toward the extraction cleaner 12 of FIG. 1.

The wand 46 depicted in FIG. 2 has a tool end 46T and a hose end 46H. As the names imply, the tool end 46T is connectable to the tool body 10, e.g., via a latching mechanism 47. Although not visible from the perspective of FIG. 2, the wand 46 also includes an axial coupling piece 146T (see FIG. 4) that protrudes from the tool end 46T into the tool body 10. The hose end 46H situated opposite the tool end 46T is connected to the accessory hose 13 of FIG. 1 via a collar 13C, with the collar 13C depicted in FIGS. 3 and 6. Thus, a user of the accessory tool 10T is able to selectively connect the accessory tool 10T to the extraction cleaner 12 of FIG. 1 via the accessory hose 13 using the wand 46 as an intervening connection or fluid coupling piece.

When the accessory tool 10T is connected in this manner, a user manipulating the accessory tool 10T can more easily reach the surface 11 relative to cleaning the same surface 11 using the primary structure of the extraction cleaner 12 of FIG. 1, e.g., when cleaning stairs, the corners of room, behind furniture, or when cleaning upholstery or drapes to name just a few exemplary uses. The accessory tool 10T includes respective second and first actuators 48 and 50, with "second" and "first" in this instance indicating relative position within a stream (arrow FF) of the cleaning fluid 34 of FIG. 1. That is, the first actuator 50 is located "upstream" of the second actuator 48. During use of the accessory tool 10T in this manner, the user is able to control delivery of the cleaning fluid 34 of FIG. 1 to the surface 11 by using the second actuator 48 disposed on the wand 46. For example, the second actuator 48 could be constructed as a trigger mechanism as shown, which when depressed by the user directs the cleaning fluid 34 of FIG. 1 through a spray conduit piece 550 and a spray conduit 56 as described below. Temporary diversion of the cleaning fluid 34 for the purpose of cleaning the accessory hose of FIG. 1 is provided via the first actuator 50 arranged on the wand 46, e.g., in line with the second actuator 48 on an underside of the wand 46 as shown. Also shown in FIG. 2 are optional agitators 29 disposed on the tool body 10, which as appreciated in the art may be used to scrub stubborn stains or help entrain and lift dirt and debris from the surface 11 as needed.

To assist the user in viewing the ongoing cleaning process, the tool body 10 in one or more embodiments can be constructed at least partially from a transparent or translucent material such as plastic, e.g., polypropylene or polyethylene. Alternatively, such as in the illustrated example construction of FIG. 2, cleaning process visibility is provided by a sight window 45 connected to the wand 46. For example, the wand 46 can define an opening 43, with the sight window 45 being disposed within the opening 43. The sight window 45 can be constructed from a transparent or translucent material of the example types noted above to provide a user with a view of the cleaning process, in this instance by providing a view into the wand 46. Beneficial functions of the optional sight window 45 are described in further detail below with particular reference to FIG. 6.

Figure 3:
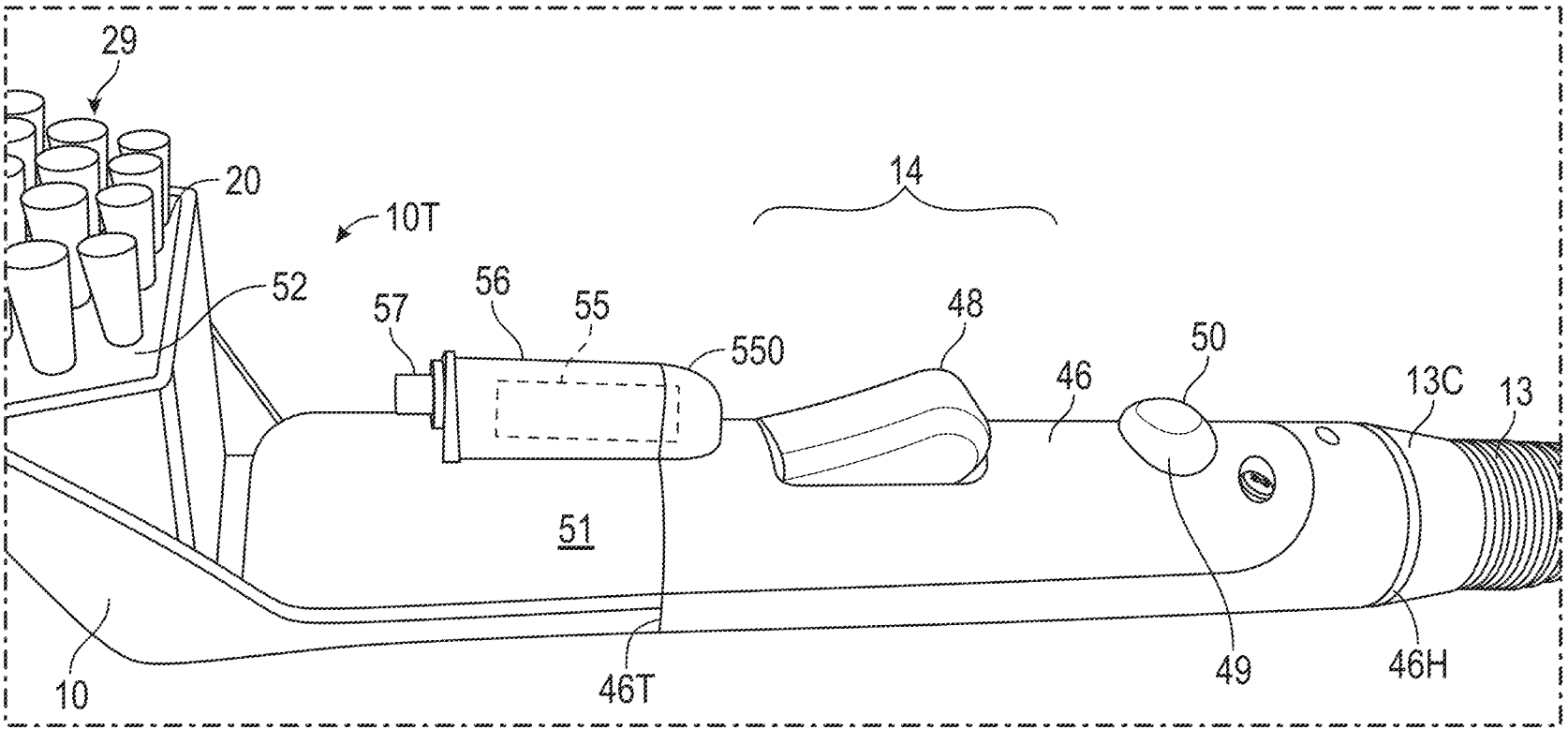
FIG. 3 is a bottom perspective view of a portion of a representative accessory tool and the wand shown in FIG. 2.

Referring to FIG. 3, an underside of the accessory tool 10T and wand 46 of FIG. 2 are shown to illustrate two separate and independent actuation mechanisms: (1) the second actuator 48 located proximate the tool end 46T of the wand 46, and (2) the first actuator 50 situated proximate the hose end 46H. As noted above, as the cleaning fluid 34 of FIG. 1 is delivered through the accessory hose 13 as a liquid stream, the first actuator is located "upstream" of the second actuator 48 relative to a normal steady-state flow direction of the cleaning fluid 34. In some aspects, an annular or arcuate standoff 49 at least partially circumscribes or surrounds an outer perimeter of the first actuator 50 in a possible construction. Such a standoff 49 can help prevent inadvertent actuation of the first actuator 50, such as by preventing an accidental depression of the first actuator 50 when the first actuator 50 is embodied as a push-button actuator as shown.

As best shown in FIG. 2, the accessory tool 10T also includes the suction nozzle described above with reference to FIG. 1, with the suction nozzle 20 being disposed on a working surface 52 of the tool body 10 proximate the optional agitators 29. Various locations, shapes, and sizes of the suction nozzle 20 are possible in different embodiments, with a typical construction being a relatively thin slot-like opening optimized for lifting fluids and debris from the surface 11, as appreciated in the art. The agitators 29 shown in FIGS. 2 and 3, e.g., rubber or polymeric brushes, cones, needles, bristles, etc., may be provided on the working surface 52 of the tool body 10.

Continuing with the exemplary embodiment of FIG. 3, the accessory tool 10T includes a spray nozzle 55 disposed within the spray conduit 56, with a spray tip 57 protruding from the spray conduit 56 toward the tool body 10. In such an embodiment, a user may connect the wand 46 to the accessory tool 10T at the tool end 46T. Doing so connects the spray conduit 56 to the mating spray conduit piece 550 disposed on the wand 46. Thus, the wand 46 may be used with a wide variety of accessory tools 10T within the scope of the disclosure, provided the accessory tool 10T includes the spray conduit 56 or other compatible means for connecting the spray conduit 56 to the accessory tool 10T. The accessory tool 10T is then ready for use once connected to the wand 46, and once the wand 46 has been connected to the accessory hose 13, e.g., via the illustrated collar 13C.

Figure 4:
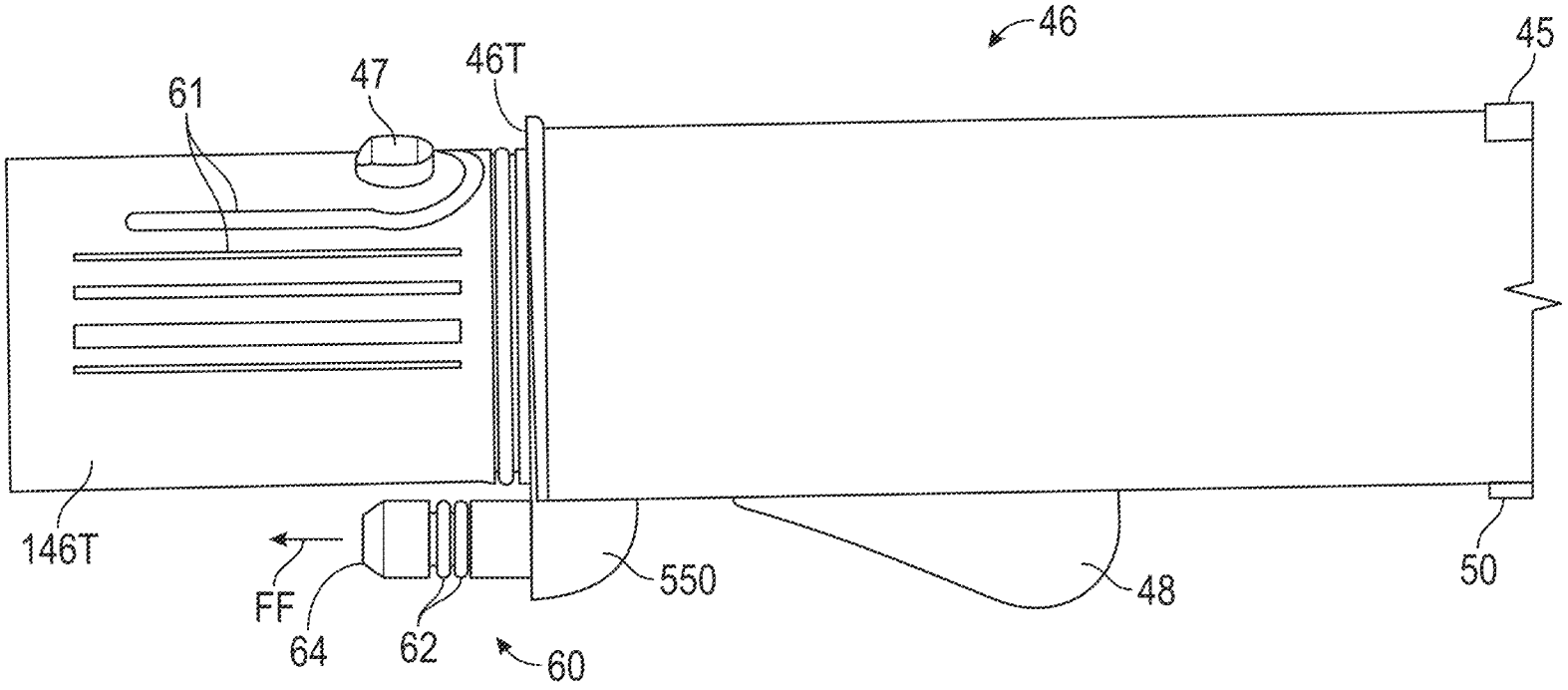
FIG. 4 is a side elevational view of a portion of the wand shown in FIG. 3.

Referring briefly to FIG. 4, a portion of the wand 46 is shown detached from the accessory tool 10T of FIGS. 1-3 for illustrative simplicity, with the sight window 45 and the first actuator 50 of FIG. 2 being partially visible in this fragmentary view. As appreciated by those skilled in the art, the wand 46 in a typical construction includes the spray conduit piece 550, with the spray conduit piece 550 terminating in a spray nozzle (see FIG. 5), e.g., a tube fitting having an O-ring seal 62 and a fluid outlet 64 through which is directed some of the cleaning fluid 34 of FIG. 1, as represented by arrow FF in FIG. 4. The axial end piece 146T of the wand 46 is received within the tool body 10 of FIG. 2, with an optional fluted or grooved surface 61 and the latching mechanism 47 together ensuring a positive locking engagement of the wand 46 and the accessory tool 10T of FIGS. 1-3. Thus, when the user activates the second actuator 48, in this instance embodied as a finger-actuatable trigger mechanism as stated above, the cleaning fluid 34 of FIG. 1 flows through the spray nozzle 55 and exits the fluid outlet 64. From there, the cleaning fluid 34 enters the spray conduit 56 (see FIGS. 2 and 3) whereupon the admitted cleaning fluid is distributed by the spray tip 57 onto the surface 11 being cleaned.

Figure 5:
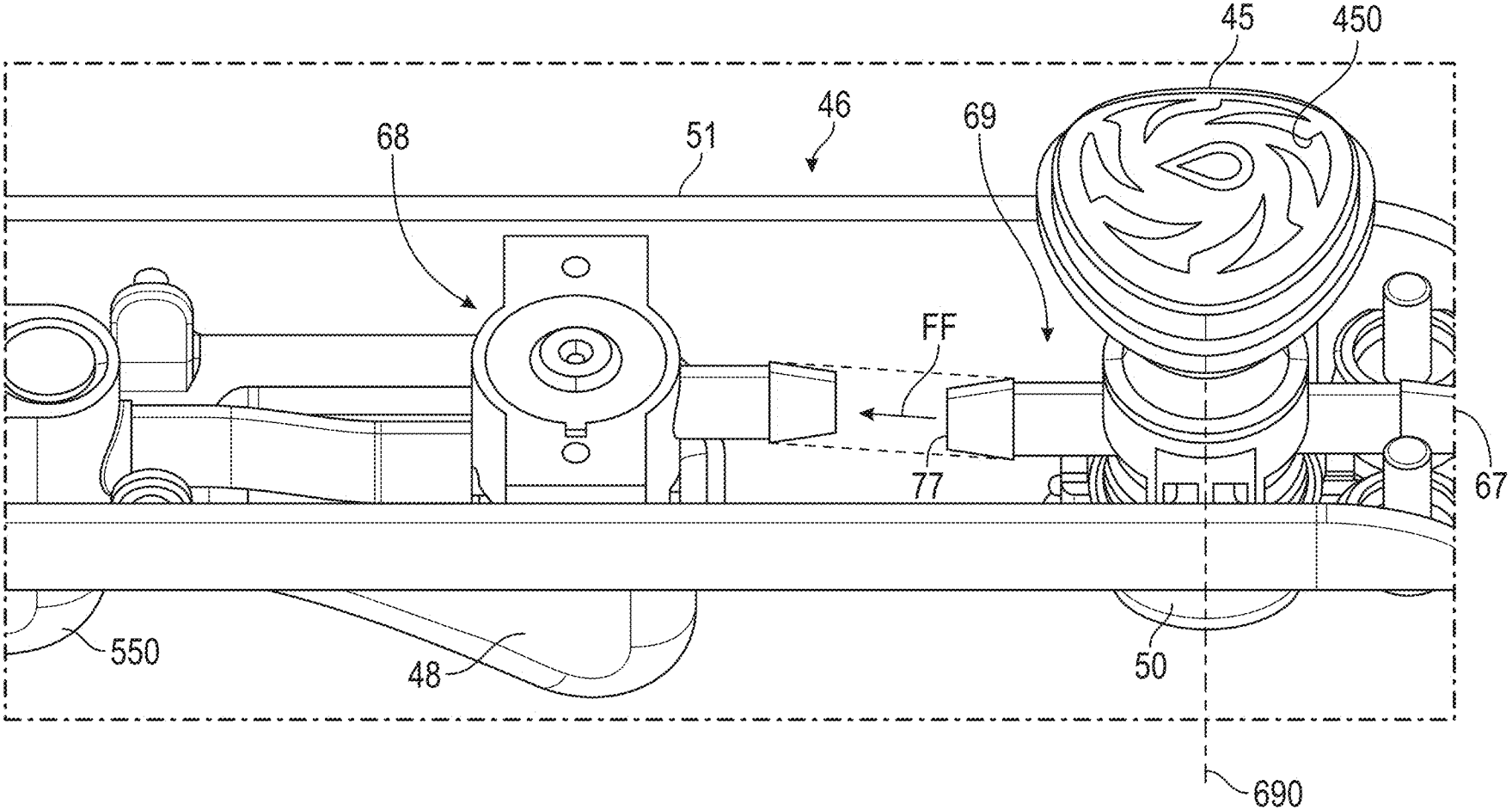
FIG. 5 is a top perspective view of the wand shown in FIGS. 2-4 with an upper wall of the wand removed.
Figure 6:
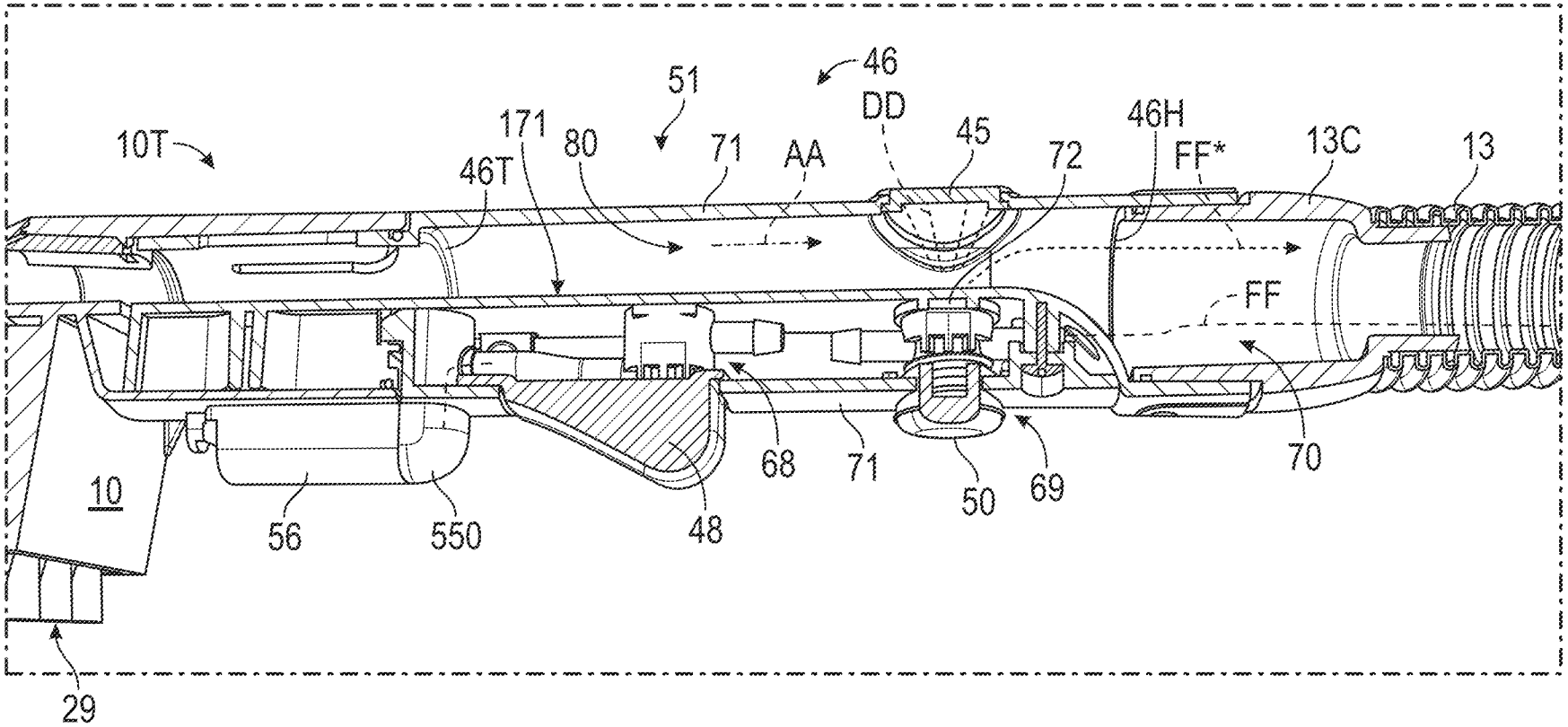
FIG. 6 is a side cross-sectional view of the wand depicted in FIG. 5, taken along line 6-6 of FIG. 2 and illustrating the integrated hose cleanout feature of the present disclosure.

FIGS. 5 and 6 provide an internal view into the wand 46 of FIG. 4, with FIG. 5 showing an upper half of the wand 46 removed for clarity and FIG. 6 showing a cross-sectional view of the wand 46 taken along cut line 6-6 of FIG. 2. The wand 46 includes a conduit body 51 with an outer wall 71 and an inner wall 171, as best shown in FIG. 6. The outer wall 71 surrounds the inner wall 171 and contains a fluid delivery pathway 70 and an airflow pathway 80. The fluid delivery pathway 70 of FIG. 6 is configured to connect to the fluid delivery system 30 of FIG. 1 at the hose end 46H of the wand 46, while the airflow pathway 80 is configured to connect to the fluid recovery system 18, likewise at the hose end 46H of the wand 46. As described above, the spray nozzle 55 of FIG. 4 is in fluid communication with the fluid delivery pathway 70 shown in FIG. 6.

As part of the contemplated construction, the wand 46 includes or is coupled to respective first and second valves 69 and 68, as best shown in FIG. 5. The second valve 68 is operable for selectively directing the liquid stream (arrow FF of FIG. 5), i.e., a portion of the cleaning fluid 34 of FIG. 1, to the spray nozzle 55 of FIG. 4. This occurs when the hose end 46H of the wand 46 is attached to the extraction cleaner 12 of FIG. 1 via the accessory hose 13 and a user actuates the second actuator 48 of FIGS. 2-5. Thus, the second valve 68 remains closed until a user opens the second valve 68 to dispense cleaning fluid 34 onto the surface 11 being cleaned.

The first valve 69 in turn is operable for selectively diverting the liquid stream into the airflow pathway 80 of FIG. 6, as indicated by arrow FF*. Activation of the first valve 69 thus temporarily starves the second valve 68 of its supply of cleaning fluid 34 when a user wishes to backflush the accessory hose 13. The first valve 69 includes a center axis 690 as shown in FIG. 5. In a possible construction, the above-described sight window is coaxially aligned with the center axis 690, i.e., is positioned directly above the first valve 69, with such optional positioning allowing a user to view a diverted liquid stream (arrow DD of FIG. 6) spraying onto the sight window 45 when the cleaning fluid 34 is temporarily diverted through the first valve 69 as described below.

To that end, the outer wall 71 and the inner wall 171 of the conduit body 51 together define, surround, or enclose at least a portion of the fluid delivery pathway 70 and the airflow pathway 80. While the fluid delivery pathway 70 is left open as shown in FIG. 6 for illustrative clarity, actual constructions can include hoses, pipes, or tubing and possible fittings extending within the accessory hose 13 and connecting the first valve 69 to the fluid delivery system 30 of FIG. 1, as appreciated in the art.

Figure 7A:
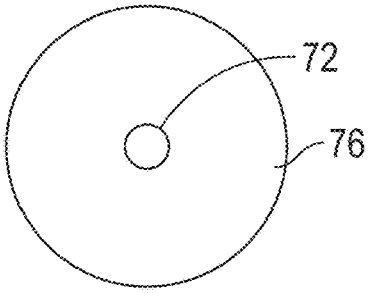
FIGS. 7A and 7B illustrate alternative embodiments of a nozzle usable as part of the integrated hose cleanout feature described herein.
Figure 7B:
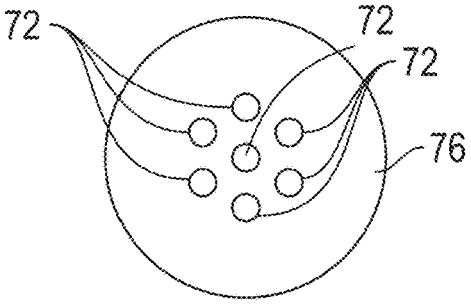
Figure 8:
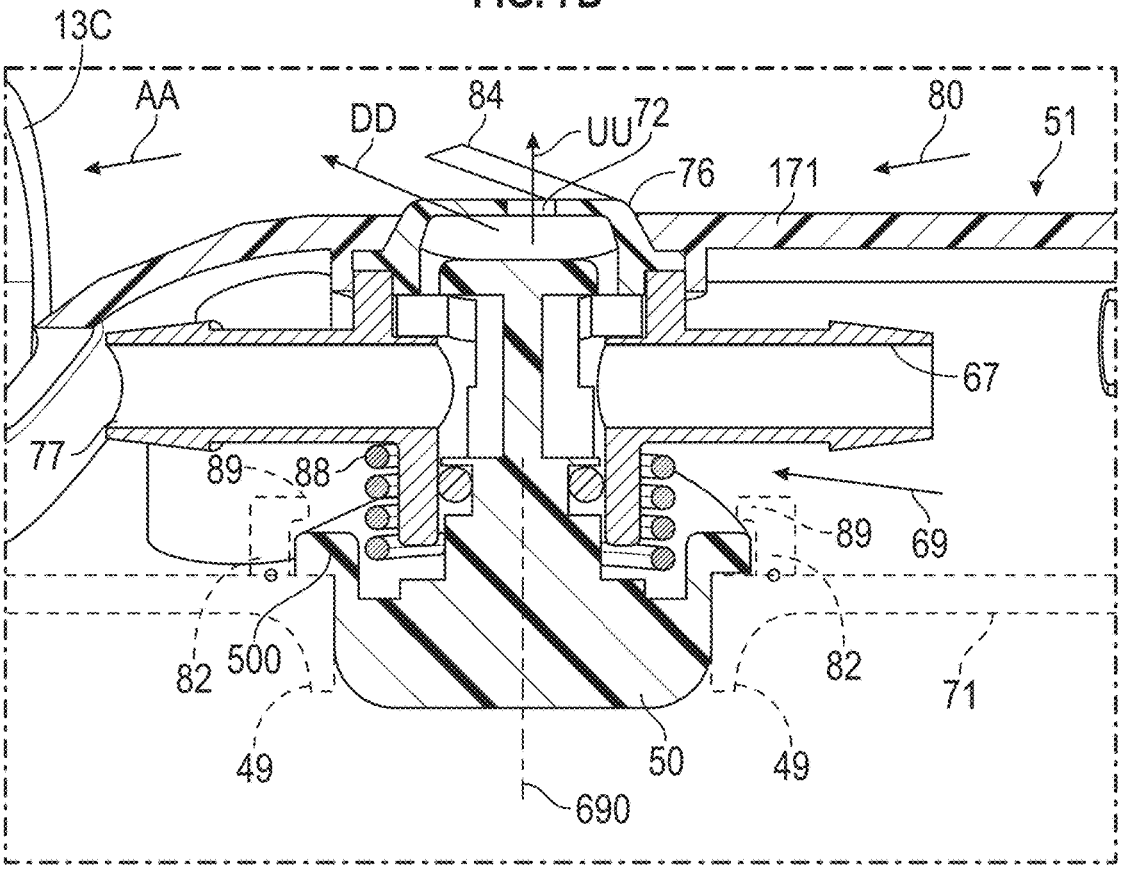
FIG. 8 is an enlarged cross-sectional illustration of a diverter valve ("first valve") usable with the wand shown in FIG. 6 and taken along line 6-6 of FIG. 2.

The first valve 69 in the illustrated embodiment of FIGS. 5 and 6 can be embodied as a normally-off, spring-biased valve. An example of the first valve 69 is shown in FIG. 8, with a spring 88, e.g., a coil spring, biasing the first actuator 50 in an axially outward direction. Such a construction enables (1) a steady-state position configured to direct the liquid stream to the second valve 68, i.e., the default "off" state shown in FIG. 5, and (2) a bypass position as shown in FIG. 6 in which the first valve 69 is configured to temporarily divert the liquid stream into the airflow pathway 80 to clean the accessory hose 13. Fluid diversion in this manner can occur through one or more orifices 72 of the inner wall 171, with different options for implementing the orifices 72 described below with reference to FIGS. 7A and 7B.

As part of the structure depicted in FIGS. 5 and 6, the first actuator 50 can be configured to transition the first valve 69 from the above-noted steady-state position to the bypass position. For example, the first actuator 50 in one or more embodiments can include a spring-biased button or plunger that protrudes from the outer wall 71 of the conduit body 51. The first actuator 50 in such an embodiment can be translated toward the conduit body 51, such as when the user pushes an optional spring-biased button or plunger as illustrated in FIG. 6 while operating the accessory tool 10T. Movement of the first actuator 50 in this manner results in the above-noted temporary diversion of the liquid stream through the orifice(s) 72, which in this instance would be directed upward toward and onto the optional sight window 45 positioned in an opening defined in the outer wall 71 (FIG. 6). Such a sight window 45 would provide a user of the wand 46 with a view of the airflow pathway 80. While the sight window 45 could be a single lens (FIG. 2), other embodiments of the sight window 45 may include a window pattern or logo 450 as shown in FIG. 5 to provide a customizable appearance. In some aspects, the sight window 45 can be integrally formed with the wand 46, such as by forming at least a portion of the outer wall 71 adjacent the orifice(s) 72 of a transparent or translucent material.

Airflow (arrows AA) within the airflow pathway 80 of FIG. 6 would draw the diverted liquid stream (arrows DD) back toward and into the accessory hose 13 as indicated by arrow FF*. Although omitted from FIG. 6, as noted above and shown in FIGS. 2 and 8 the wand 46 can optionally include the standoff 49 at least partially circumscribing or surrounding an outer perimeter of the spring-biased button or plunger 50, with the annular standoff 49 protruding from the outer wall 71 to inhibit an unintended activation or movement of the first actuator 50 toward the conduit body 51.

Aspects of the present disclosure utilize the first valve 69 in-line with the second valve 68 to take advantage of a high-pressure environment within the fluid delivery pathway 70 for rinsing/flushing the accessory hose 13. This high-pressure environment can occur, for example, in configurations in which the fluid pump 44 is constantly supplying cleaning fluid to the second valve 68 rather than supplying cleaning fluid only on-demand when the second actuator 48 is actuated. When cleaning fluid stored within the fluid supply tank 32 is pumped through the fluid delivery pathway 70 to the second valve 68, which is in a closed position until actuated by the second actuator 48, this results in a high-pressure environment within the fluid delivery pathway 70 upstream of the second valve 68. Because the first valve 69 is disposed directly upstream of the second valve 68, when the first valve 69 is actuated, an outlet is provided for the cleaning fluid that is under pressure within the fluid delivery pathway 70 to be re-directed upward (arrows DD) into the airflow pathway 80 (arrows FF*). This configuration facilitates providing cleaning fluid at a sufficient pressure such that the cleaning fluid can be diverted upward, on demand, into the airflow pathway 80 for rinsing/flushing the accessory hose 13, when the first actuator 50 is actuated.

The number, size, shape, and relative position of the orifices 72 noted above may vary within the scope of the disclosure. In FIG. 7A for instance, a single orifice 72 is defined by a radial projection or cap 76 of the inner wall 171 shown in FIG. 6. Use of the cap 76 allows the orifice 72 to be situated a distance above the inner wall 171, which in turn may help diffuse the liquid stream into the passing airstream. The cap 76 can be a separate component, as illustrated, or the cap 76 may be integrally formed with adjacent portions of the inner wall 171. Alternatively, the cap 76 can define a plurality of the orifices 72 as shown in FIG. 7B. In different constructions, the orifices 72 can be of equal size and a same shape, e.g., circular as shown, or the orifices 72 can be of varied sizes and/or shapes. Likewise, the orifices 72 could be equally spaced as shown in FIG. 7B, or the orifices 72 could be distributed asymmetrically or irregularly on the cap 76 in order to achieve a desired distribution or diffusion of the liquid stream into the airflow pathway 80 of FIG. 6.

Referring now to the cross-sectional view of FIG. 8 taken along cut line 6-6 of FIG. 2, the cap 76 can be positioned above the first valve 69 in some implementations, with the first valve 69 being configured as an inline valve as shown having coaxially aligned input and output ports 67 and 77, respectively. For instance, the first valve 69 can have the center axis 690, with the cap 76 being coaxially aligned with the center axis 690 in one or more embodiments. Optionally, the sight window 45 of FIGS. 2, 5, and 6 can also being coaxially aligned with the center axis 690 such that the diverted liquid stream is directed through the orifice(s) 72 of the cap 76 or the inner wall 171 directly upward toward the sight window 45, as indicated in FIG. 8 by arrow UU. In such an implementation the liquid stream would tend to splash off of the sight window 45 in view of the user before being entrained in the passing airflow (arrow AA) and suctioned into the accessory hose 13 of FIG. 1 through the collar 13C, thus carrying off accumulated debris from within the accessory hose 13.

As shown in FIG. 8, the wand 46 can optionally include a detent device 82 in engagement with the first actuator 50 when the latter is embodied as the spring-biased button or plunger as shown and as described above. The detent device 82 in such an embodiment is configured to provide tactile and/or audible feedback to a user of the wand 46 when the user translates the first actuator 50 toward the conduit body 51. For instance, the detent device 82 could be embodied as a pivoting or hinged piece having a leading edge 89, with the detent device 82 being connected to the outer wall 71 and configured to engage a perimeter flange 500 of the first actuator 50. When the user pushes on the first actuator 50, the perimeter flange 500 contacts the leading edge 89 and urges the detent device 82 to rotate away from the center axis 690 as shown, with the detent device 82 possibly emitting an audible "click" as confirmation. A user can also feel the resistance of the detent device 82 as it rotates or pivots away from the center axis 690, thus providing a tactile and/or audible confirmation that the first actuator 50 has been moved or translated a sufficient distance to transition the first valve 69 to the bypass position described above. As noted above, some embodiments can require the user to depress the first actuator 50 again to resume delivery of the fluid stream to the tool body 10, while other embodiments can require the user to maintain an apply force on the first actuator 50 to maintain the bypass position of the first valve 69.

The cap 76 could also be connected to or formed integrally with an optional baffle 84. As contemplated herein, the baffle 84 is configured to deflect the liquid stream toward the hose end 46H (FIG. 2) of the wand 46 when the liquid stream passes through the orifice(s) 72. In such an embodiment, the sight window 45 of FIG. 2 could be positioned a distance away from the center axis 690 of the first valve 69, unlike in the embodiment shown in FIG. 5, so that the deflected liquid stream (arrow DD) still contacts the sight window 45 in spite of the off-axis alignment. Other constructions usable with the baffle 84 include constructing the outer walls 71 of the conduit body 51 from transparent or translucent materials to allow the diverted liquid stream to be visible over a larger area.

The wand 46 described above with reference to FIGS. 1-8 can therefore be used in its normal role as a fluid coupler or connector piece that couples the accessory tool 10T of FIG. 2 to the extraction cleaner 12 of FIG. 1 via the accessory hose 13. In the course of using the extraction cleaner 12, features of the wand 46 can be selectively used to prevent accumulation or buildup of extracted debris within the accessory hose 13 and/or to rinse or flush the accessory hose 13. Relative to traditional hose cleanout features that often require the accessory hose 13 to be detached from the accessory tool 10T and connected to a separate device for backflushing and extraction of accumulated debris, the present approach is user friendly, requiring only periodic actuation of the first actuator 50 and the first valve 69 of FIG. 6 by the user to provide the desired hose cleanout function described in detail hereinabove.

In addition, the fluid delivery and hose cleanout features described herein are provided utilizing a pair of valves 68, 69 disposed in series along a single fluid path within the wand 46. This configuration may provide cost savings and utilize less space within the wand 46 than more complex systems that utilize multiple different flow paths, valves, and diverters. Further, as described above, disposing the first valve 69 directly upstream of the second valve 68 allows a high-pressure environment to be generated within the fluid delivery pathway 70 by the normally closed second valve 68 that can be utilized by the first valve 69 to provide cleaning fluid, under pressure, into the airflow pathway 80 for rinsing/flushing the accessory hose 13, when the first actuator 50 is actuated.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

The following Clauses provide representative configurations of a wand, an extraction cleaner, and a tool assembly as disclosed herein.

Clause 1: A wand for use with an extraction cleaner having a fluid delivery system and a fluid recovery system, the wand including a conduit body containing therein a fluid delivery pathway and an airflow pathway, wherein the fluid delivery pathway is configured to connect to the fluid delivery system at a hose end of the wand and supply a cleaning fluid as a liquid stream, and the airflow pathway is configured to connect to the fluid recovery system at the hose end of the wand; a spray nozzle in fluid communication with the fluid delivery pathway; a first valve operable for selectively diverting the liquid stream into the airflow pathway to clean the accessory hose; and a second valve operable for selectively directing the liquid stream to the spray nozzle when the hose end of the wand is attached to the extraction cleaner via an accessory hose.

Clause 2: The wand of clause 1, wherein the conduit body includes an outer wall and an inner wall together defining the airflow pathway, and wherein the first valve includes: a steady-state position configured to direct the liquid stream to the second valve; and a bypass position configured to divert the liquid stream through one or more orifices in the inner wall and into the airflow pathway.

Clause 3: The wand of clauses 1 or 2, further including an actuator configured to transition the first valve from the steady-state position to the bypass position.

Clause 4: The wand of clause 3, wherein the actuator includes a spring-biased button or plunger.

Clause 5: The wand of clause 4, further including an annular standoff at least partially circumscribing or surrounding an outer perimeter of the spring-biased button or plunger and protruding from the conduit body.

Clause 6: The wand of clauses 4 or 5, further including a detent device in engagement with the spring-biased button or plunger, wherein the detent device is configured to provide tactile and/or audible feedback to a user of the wand when the user translates the spring-biased button or plunger toward the conduit body.

Clause 7: The wand of any of clauses 2-6, wherein the outer wall defines an opening, the wand further including a sight window disposed within the opening and providing a user of the wand with a view of the fluid delivery pathway.

Clause 8: The wand of clause 7, wherein the second valve includes a center axis, and wherein the sight window is coaxially aligned with the center axis.

Clause 9: The wand of any of clauses 2-8, where in the inner wall defines or is connected to a cap that is positioned above the first valve, and wherein the cap defines the one or more orifices.

Clause 10: The wand of clause 9, wherein the cap is connected to or formed integrally with a baffle, and wherein the baffle is configured to deflect the liquid stream toward the hose end of the wand when the liquid stream passes through the one or more orifices.

Clause 11: The wand of any of clauses 1-10, wherein the spray nozzle is connected to or formed integrally with the conduit body, and wherein the second valve is actuatable via a trigger mechanism disposed on an undersurface of the conduit body.

Clause 12: An extraction cleaner including a fluid delivery system; a fluid recovery system; an accessory hose connectable to the fluid delivery system and the fluid recovery system; an accessory tool; and a wand having a tool end connectable to the accessory tool and a hose end connectable to the accessory hose, the wand including a conduit body containing a fluid delivery pathway and an airflow pathway, wherein the fluid delivery pathway is configured to connect to the fluid delivery system at a hose end of the wand and receive a cleaning fluid as a liquid stream, and the airflow pathway is configured to connect to the fluid recovery system at the hose end of the wand; a spray nozzle in fluid communication with the fluid delivery pathway; a first valve operable for selectively diverting the liquid stream into the airflow pathway to clean the accessory hose; and a second valve operable for selectively directing the liquid stream to the spray nozzle when the hose end of the wand is attached to the extraction cleaner via the accessory hose.

Clause 13: The extraction cleaner of clause 12, wherein the conduit body includes an outer wall and an inner wall together at least partially defining the airflow pathway, and wherein the first valve includes: a steady-state position configured to direct the liquid stream to the second valve; a bypass position in which the first valve is configured to divert the liquid stream through one or more orifices in the inner wall and into the airflow pathway; and a spring-biased button or plunger configured to transition the second valve from the steady-state position to the bypass position.

Clause 14: The extraction cleaner of clause 13, wherein the spring-biased button or plunger protrudes from the outer wall of the conduit body.

Clause 15: The extraction cleaner of clause 14, further including an annular standoff at least partially circumscribing or surrounding an outer perimeter of the spring-biased button or plunger and protruding from the outer wall of the conduit body.

Clause 16: The extraction cleaner of any of clauses 13-15, further including a detent device in engagement with the spring-biased button or plunger, wherein the detent device is configured to provide tactile and/or audible feedback to a user of the wand when the user actuates the spring-biased button.

Clause 17: The extraction cleaner of any of clauses 13-16, wherein the outer wall defines an opening, the extraction cleaner further including a sight window disposed within the opening and providing a user of the wand with a view of the fluid delivery pathway.

Clause 18: The extraction cleaner of clause 17, wherein the first valve includes a center axis, and wherein the sight window is coaxially aligned with the center axis.

Clause 19: A tool assembly for use with an extraction cleaner having an accessory hose, a fluid delivery system, and a fluid recovery system, the tool assembly including an accessory tool having a tool body defining a suction nozzle; and a wand including a conduit body having a tool end configured to connect to the accessory tool and a hose end configured to connect to the accessory hose, the conduit body containing a fluid delivery pathway and an airflow pathway respectively connectable via the accessory hose to the fluid delivery system and the fluid recovery system; a sight window disposed within a wall of the conduit body; a spray nozzle configured to direct a cleaning fluid as a liquid stream from the fluid delivery pathway onto a surface to be cleaned; a first valve configured when actuated to a bypass position to direct the liquid stream into the airflow pathway and toward the sight window to clean the accessory hose, and to direct the liquid stream to a second valve when in a default steady-state position; and the second valve, wherein the second valve is configured when actuated to direct the liquid stream from the first valve to the spray nozzle.

Clause 20: The tool assembly of clause 19, where in the first valve is an inline valve having coaxially aligned input and output ports.

While some of the best modes have been described in detail, various alternative designs may exist for practicing the present teachings defined in the appended claims. Those skilled in the art will recognize that modifications may be made to the disclosed embodiments without departing from the scope of the subject disclosure. Moreover, the present concepts expressly include combinations and sub-combinations of the described elements and features. The detailed description and the drawings are supportive and descriptive of the present teachings, with the scope of the present teachings defined solely by the claims.

What is claimed is:

1. A wand for use with an extraction cleaner having a fluid delivery system and a fluid recovery system, the wand comprising:

a conduit body containing therein a fluid delivery pathway and an airflow pathway, wherein the fluid delivery pathway is configured to connect to said fluid delivery system at a hose end of said wand and supply a cleaning fluid as a liquid stream, and wherein the airflow pathway is configured to connect to said fluid recovery system at the hose end of said wand;

a spray nozzle in fluid communication with the fluid delivery pathway;

a first valve operable for selectively diverting the liquid stream into the airflow pathway to clean an accessory hose, wherein an inner wall of the conduit body defines or is connected to a cap that is positioned above the first valve, wherein the cap defines one or more orifices and is connected to or formed integrally with a baffle, and wherein the baffle is configured to deflect the liquid stream toward the hose end of said wand when the liquid stream passes through the one or more orifices; and a second valve operable for selectively directing the liquid stream to the spray nozzle when the hose end of said wand is attached to said extraction cleaner via the accessory hose.

2. The wand of claim 1, wherein an outer wall and the inner wall of the conduit body together defining the airflow pathway, and wherein the first valve includes a steady-state position configured to direct the liquid stream to the second valve and a bypass position configured to divert the liquid stream through the one or more orifices in the inner wall and into the airflow pathway.

3. The wand of claim 2, further comprising:

an actuator configured to transition the first valve from the steady-state position to the bypass position.

4. The wand of claim 3, wherein the actuator includes a spring-biased button or plunger.

5. The wand of claim 4, further comprising:

an annular standoff at least partially circumscribing or surrounding an outer perimeter of the spring-biased button or plunger and protruding from the conduit body.

6. The wand of claim 4, further comprising:

a detent device in engagement with the spring-biased button or plunger, wherein the detent device is configured to provide tactile and/or audible feedback to a user of said wand when the user translates the spring-biased button or plunger toward the conduit body.

7. The wand of claim 2, further comprising:

an opening defined by the outer wall; and a sight window disposed within the opening and providing a user of said wand with a view of the fluid delivery pathway.

8. The wand of claim 7, wherein the first valve includes a center axis, and wherein the sight window is coaxially aligned with the center axis.

9. The wand of claim 1, wherein the spray nozzle is connected to or formed integrally with the conduit body, and wherein the second valve is actuatable via a trigger mechanism disposed on an undersurface of the conduit body.

10. An extraction cleaner comprising:
a fluid delivery system;
a fluid recovery system;
an accessory hose connectable to the fluid delivery system and the fluid recovery system;
an accessory tool; and
a wand having a tool end connectable to the accessory tool and a hose end connectable to the accessory hose, the wand comprising:
a conduit body including an outer wall, the conduit body containing a fluid delivery pathway and an airflow pathway, wherein the fluid delivery pathway is configured to connect to the fluid delivery system at the hose end of the wand and receive a cleaning fluid as a liquid stream, and wherein the airflow pathway is configured to connect to the fluid recovery system at the hose end of the wand;
a spray nozzle in fluid communication with the fluid delivery pathway;
a first valve operable for selectively diverting the liquid stream into the airflow pathway to clean the accessory hose;
a second valve operable for selectively directing the liquid stream to the spray nozzle when the hose end of the wand is attached to said extraction cleaner via the accessory hose;
an opening defined by the outer wall; and
a sight window disposed within the opening and providing a user of the wand with a view of the fluid delivery pathway.

11. The extraction cleaner of claim 10, wherein an inner wall and the outer wall of the conduit body together at least partially define the airflow pathway, and wherein the first valve includes a steady-state position configured to direct the liquid stream to the second valve, a bypass position in which the first valve is configured to divert the liquid stream through one or more orifices in the inner wall and into the airflow pathway, and a spring-biased button or plunger configured to transition the second valve from the steady-state position to the bypass position.

12. The extraction cleaner of claim 11, wherein the spring-biased button or plunger protrudes from the outer wall of the conduit body.

13. The extraction cleaner of claim 11, further comprising:
an annular standoff at least partially circumscribing or surrounding an outer perimeter of the spring-biased button or plunger and protruding from the outer wall of the conduit body.

14. The extraction cleaner of claim 11, further comprising:
a detent device in engagement with the spring-biased button or plunger, wherein the detent device is configured to provide tactile and/or audible feedback to a user of the wand when the user actuates the spring-biased button.

15. The extraction cleaner of claim 10, wherein the first valve includes a center axis, and wherein the sight window is coaxially aligned with the center axis.

16. A tool assembly for use with an extraction cleaner having an accessory hose, a fluid delivery system, and a fluid recovery system, the tool assembly comprising:
an accessory tool having a tool body defining a suction nozzle; and
a wand comprising:
a conduit body having a tool end configured to connect to the accessory tool and a hose end configured to connect to said accessory hose, the conduit body containing a fluid delivery pathway and an airflow pathway respectively connectable via said accessory hose to said fluid delivery system and said fluid recovery system;
a sight window disposed within a wall of the conduit body;
a spray nozzle configured to direct a cleaning fluid as a liquid stream from the fluid delivery pathway onto a surface to be cleaned; and
a first valve configured, when actuated to a bypass position, to direct the liquid stream into the airflow pathway and toward the sight window to clean said accessory hose, and to direct the liquid stream to a second valve when in a default steady-state position, wherein the second valve is configured, when actuated, to direct the liquid stream from the first valve to the spray nozzle.

17. The tool assembly of claim 16, wherein the first valve is an inline valve having coaxially aligned input and output ports.

* * * * *